US009193572B2

(12) United States Patent
Finkbeiner et al.

(10) Patent No.: US 9,193,572 B2
(45) Date of Patent: Nov. 24, 2015

(54) VEHICLE LIFTING PLATFORM FOR LIFTING LOADS, PARTICULARLY VEHICLES

(75) Inventors: Gerhard Finkbeiner, Freudenstadt (DE); Josef Femböck, Neuötting (DE)

(73) Assignee: Gerhard Finkbeiner, Freudenstadt (DE)

( * ) Notice: Subject to any disclaimer, the term of this patent is extended or adjusted under 35 U.S.C. 154(b) by 1045 days.

(21) Appl. No.: 13/264,770

(22) PCT Filed: Apr. 19, 2010

(86) PCT No.: PCT/EP2010/002371

§ 371 (c)(1), (2), (4) Date: Oct. 17, 2011

(87) PCT Pub. No.: WO2010/118893

PCT Pub. Date: Oct. 21, 2010

(65) Prior Publication Data

US 2012/0037864 A1 Feb. 16, 2012

(30) Foreign Application Priority Data

Apr. 17, 2009 (DE) ..... 20 2009 005 661 U

(51) Int. Cl.
*B66F 7/04* (2006.01)
*B66F 3/44* (2006.01)
*B66F 7/28* (2006.01)

(52) U.S. Cl.
CPC ... *B66F 7/04* (2013.01); *B66F 3/44* (2013.01); *B66F 7/28* (2013.01)

(58) Field of Classification Search
CPC ..... B66F 3/00; B66F 3/44; B66F 7/00; B66F 7/04; B66F 7/28; B66F 7/20; B66F 7/26; B66F 7/0691; B66F 7/065; B66F 7/10
USPC ..... 254/93 R, 90, 122, 124, 126, 9 C, 133 R; 269/17
See application file for complete search history.

(56) References Cited

U.S. PATENT DOCUMENTS 5,484,134 A * 1/1996 Francis ..... 254/2 B
6,117,575 A * 9/2000 Dinsdale ..... 429/1

(Continued)

FOREIGN PATENT DOCUMENTS

DE 60313633 1/2008
EP 1958827 8/2008

OTHER PUBLICATIONS

International Search report corresponding to International Application No. PCT/EP2010/002371, dated Jul. 22, 2010.

(Continued)

*Primary Examiner* — Lee D Wilson
*Assistant Examiner* — Seahee Yoon
(74) *Attorney, Agent, or Firm* — Renner, Otto, Boisselle & Sklar, LLP

(57) ABSTRACT

The invention relates to a vehicle lifting platform for lifting vehicles, in particular motor vehicles or similar, comprising load receiving means, a drive device which raises and lowers the load receiving means and which can be controlled by a drive control, also comprising an energy accumulator which supplies energy to the drive control and to the drive device. A rapid replacement device is provided on the vehicle lift platform enabling the energy accumulator or energy accumulators to be arranged in an exchangeable manner.

15 Claims, 4 Drawing Sheets

(56) References Cited

U.S. PATENT DOCUMENTS

Figure 1:
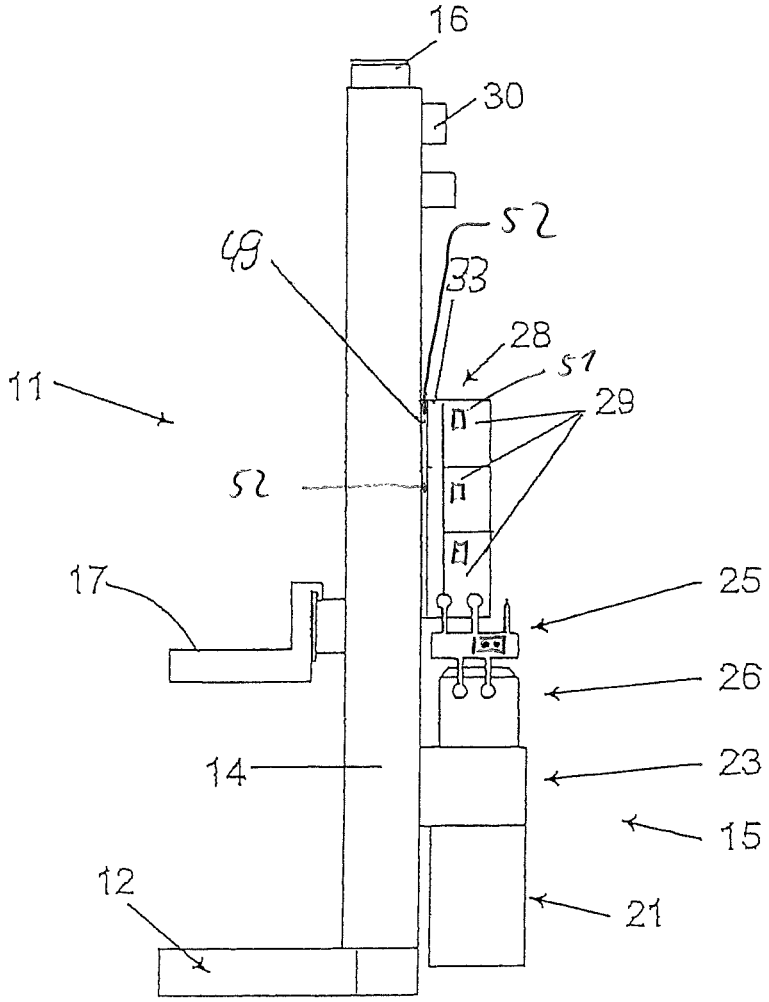

| | | | | |
|---|---|---|---|---|
| 7,500,816 | B2 * | 3/2009 | Berends et al. | 414/458 |
| 7,740,109 | B2 * | 6/2010 | Moller et al. | 187/247 |
| 2005/0045429 | A1 | 3/2005 | Baker | |
| 2006/0024575 | A1 * | 2/2006 | Robinson et al. | 429/185 |
| 2012/0043515 | A1 * | 2/2012 | Finkbeiner et al. | 254/93 R |
| 2013/0142602 | A1 * | 6/2013 | Barnts | 414/462 |

OTHER PUBLICATIONS

International Preliminary Report on Patentability for corresponding International Application No. PCT/EP2010/002371 dated Oct. 18, 2011.

* cited by examiner

Fig.3
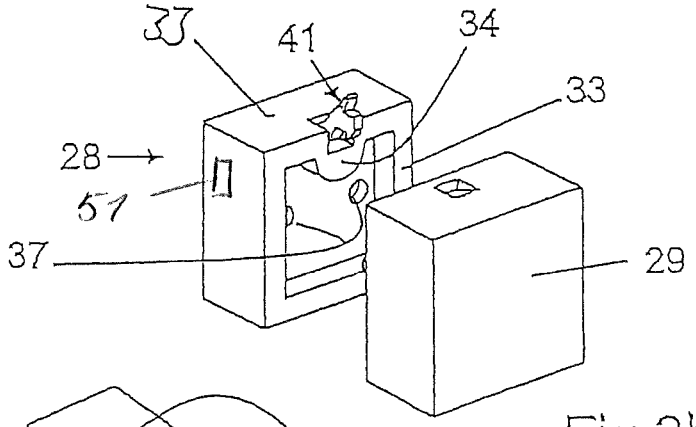
Fig.3b
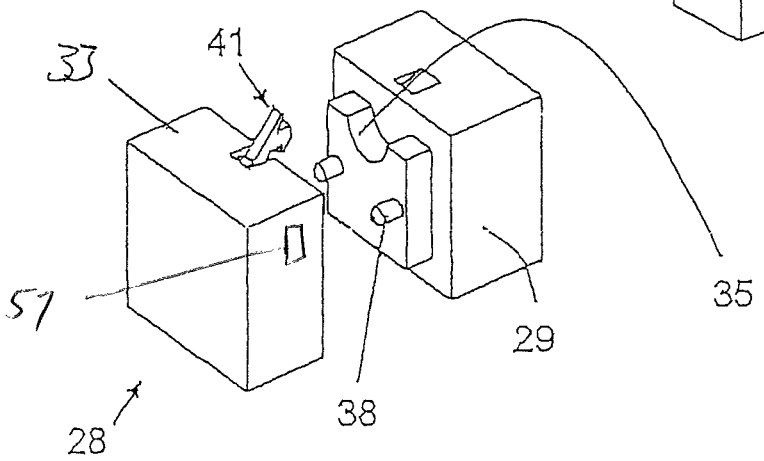
Fig.3a

VEHICLE LIFTING PLATFORM FOR LIFTING LOADS, PARTICULARLY VEHICLES

The invention relates to a vehicle lifting platform for lifting vehicles, particularly motor vehicles or similar, which includes a lifting column with a carrier led though the lifting column, on which a load handling attachment is provided.

A vehicle lifting platform of this type for vehicles is disclosed in DE 603 13 633 T2, which is also denoted as a single column vehicle lifting platform or mobile column. This vehicle lifting platform includes a lifting column with a carrier led through the lifting column. A load handling attachment is provided on the carrier, in order to hold a wheel of a vehicle from underneath, for example. This vehicle lifting platform includes a drive control, which controls drive equipment and moves the carrier up and down in relation to the lifting column. For energy supply of the drive control and the drive unit, it is intended that a battery is provided on the base frame bearing the lifting column. This here refers to lead batteries, which are also used in motor vehicles. Batteries of this type are provided fixed on the vehicle lifting platform. Charging the battery is done by an additional cable connected to the power supply network. Whilst the battery is charging, it is not possible to use the vehicle lifting platform independently of location. If a charging process takes place during use, cables lying on the work floor, which are connected to the battery, hinder further workflow.

The object of the invention is therefore to create a vehicle lifting platform, which can be operated independently of location, and facilitates a constant operational readiness, whereby the cordless arrangement of the vehicle lifting platform to a power supply network is maintained.

This object is achieved according to the invention by the features of claim 1. Further advantageous configurations and further developments are given in the further claims.

Due to the arrangement according to the invention of a quick change device for accommodating and exchange of the energy storage device(s), it is made possible that when the state of charge of the energy storage device falls below a predetermined level of charge, a simple and quick exchange of the energy storage device(s) is allowed, and a completely charged energy storage device is available for operating the vehicle lifting platform.

Due to this quick change device for quick exchange of the energy storage device, it is also possible for operational readiness to be given even when there is a power failure for a longer period of time, or working current is only available at certain operating times. In addition, manual lowering is made possible by this arrangement, even if no power supply is available from the power supply system. In addition, this arrangement has the advantage that this operation is independent of a supply network voltage. For example, a charging station can be adapted to the supply data of the local supply network, in order to charge the energy storage device(s), whereby the individual vehicle lifting platforms and their drive controls can be developed uniformly.

According to a preferred configuration of the invention, the vehicle lifting platform is designed as a so-called single column lifting platform, which comprises a lifting column and a carrier led through the lifting column, on which a load handling attachment is provided. The carrier is provided in such a way that it can be moved up and down by the drive equipment in relation to the lifting column. According to a first embodiment, it can be intended here that the carrier is led within the lifting column. According to another embodiment, the carrier can surround the lifting column. The quick change device for accommodating the energy storage device(s) can be provided on the lifting column, on the carrier or on the load handling attachment. If this lifting column is designed to be mobile, and comprises a chassis or a mobile base frame, the quick change device can also be provided on this base frame. If this single column lifting platform is designed with a lifting carriage instead of with a carrier, which is moved up and down by a drive spindle, for example, the quick change device can also alternatively be provided on this lifting carriage. A further alternative embodiment of the vehicle lifting platform is the use as an axle free jack, with can be moved within a rail lifting platform or along a working pit. Axle free jacks of this type preferably have a movable carriage. For example, axle free jacks can be provided on the moveable carriage in the form of a lift plunger, such as hydraulic cylinders, for example, or in the form of other different vehicle lifting platforms. The quick change device for accommodating the energy storage device(s) is preferably arranged on the moveable carriage or the base frame of the carriage.

According to a preferred configuration of the invention, it is intended that a wireless drive control is provided for the vehicle lifting platform. Each vehicle lifting platform can therefore be used independently of location. A connection of a cable to the drive control and/or to the power supply is not required. Thus, for example, several vehicle lifting platforms, which are separated from each other, can be provided for one vehicle, for example, and simultaneously facilitate a lifting of the vehicle. In the case of the wireless drive control of the individual vehicle lifting platforms, Bluetooth technology, GPS technology or other radio technologies, for example, are used.

A preferred embodiment of the vehicle lifting platform intends that the quick change device comprises at least one mounting frame, into which the energy storage device or devices at least partly interlock. An exact positioning of the energy storage device to the contact connections is made possible by this mounting frame, so that a secure contacting is given.

Furthermore, it is preferably intended that the mounting frame of the quick change device is designed as a plug-in socket. A quick replacement of the energy storage device can thus take place by a simple touch and removal movement of the energy storage device. This facilitates simple and secure handling.

Furthermore, it is preferably intended that the quick change device comprises a locking element, through which the energy storage device or devices are securely fastened to the mounting frame. A locking element of this type is preferably arranged in such a way that this automatically adopts a locking position after insertion of the energy storage device into the mounting frame.

Through this, a one-hand operation can be made possible for attaching the energy storage device. Handling is simplified at the same time.

Furthermore, it is preferably intended that electrical contacts, particularly sprung contact pins, are provided as connections in the mounting frame of the quick change device. Through this, a secure fit of the contact pins or contact elements of the energy storage device can be provided on the contacts of the mounting frame. Alternatively, it is also possible that contact pins of this type are provided on the energy storage device, which pins engage on preferably sprung contact pins of the quick change device.

The quick change device for accommodating the energy storage device(s) is preferably provided above a drive control of the vehicle lifting platform, which in turn is arranged directly above an electric motor or directly on the electric motor of the drive equipment on the lifting column or on the carrier of the vehicle lifting platform. Through this, it is possible that short current paths are given. This facilitates not only a saving of expensive power cables, but also the reduction of losses due to short connection cables.

A preferred embodiment of the vehicle lifting platform intends that an overlapping arrangement of the individual components is provided for moving the carrier up and down to the lifting column. For example, an electric motor is provided above drive equipment consisting of a hydraulic unit and a hydraulic control arranged in an overlying manner. The electrical drive control is arranged above this. Above the electrical drive control, the quick change device is arranged for accommodating the energy storage device(s). This design and this arrangement particularly allows a compact arrangement with short control routes, so that for example high switching currents of the electric motor and the drive control can be kept very short.

A further preferred configuration of the invention intends that high performance accumulators, particularly lithium ion batteries, are provided. These can be designed as so-called replacement accumulators. Due to the simple and quick replacement possibility of energy storage devices of this type, an operating time of only 10 to 12 working cycles, for example, can suffice, in comparison to lead accumulators according to the prior art, which usually facilitate ca. 20 working cycles.

A further preferred configuration of the vehicle lifting platform intends that a plug for a charging cable or power supply cable is provided on the drive control, and the drive control preferably includes a charging circuit for monitoring the state of charge of the energy storage device. This allows the energy storage device or replacement energy storage device, for example, and simultaneously the energy storage device(s) arranged in the lifting column, to be charged in a charging station, particularly if the lifting device is not in use.

According to a further preferred configuration of the invention, the energy storage device includes an energy storage control, which is provided on or in a housing which accommodates the energy storage device, and records the state of charge of the energy storage device. The integrated intelligence of the energy storage device and the energy management can be improved through this integration. This control preferably includes a microcontroller, which monitors the state of charge of the energy storage device. Preferably, the corresponding charging characteristic for the respective accumulator used is stored in the microcontroller, so that improved utilisation is facilitated for the charge and discharge of the respective accumulator, and can be controlled by this energy storage control. Through this, simultaneously, the residual charge of the energy storage can be safely determined, in order to prevent a premature failure or standstill of the lifting device, and to signal in good time the exchange of the energy storage device due to a fault or a residual charge, which is too low. A visual, acoustic or tactile display can preferably be provided for this, which at least signals that an exchange of the energy storage device is required due to a residual charge, which is too low. During the control of the lifting device, the current and the duration of the current can be simultaneously recorded in the charging and discharging direction by an energy storage control of this type. Through this, the current capacity can be analysed on the state of charge of the energy storage device.

According to a preferred configuration of the invention, the energy storage device includes a charging circuit, which is provided in a housing, which accommodates the energy storage device. Thus, the energy storage device can be charged both on the lifting columns as well as also directly on a separate power supply connection point, without an extra charging station being necessary. The charging circuit can be configured for use for different supply voltages or frequencies of the supply networks, and hence transform the direct current necessary for the control of the lifting device.

Furthermore, the energy storage device preferably comprises at least one data interface, particularly a wireless data interface, which communicates with the drive control. A direct transmission of data between the control and the microcontroller of the energy storage deice can thus take place. Alternatively, a wired transmission of data can also be provided, whereby a plug contact is preferably installed in the housing, which accommodates the energy storage device, which plug contact engages on a complementary plug contact of the quick change device.

A further preferred configuration of the invention intends that the quick change device, particularly the receiving space of the quick change device, is attached to a printed circuit board, which comprises conducting paths, which lead to the drive control and/or to the electric motor of the drive equipment or to the hydraulic control. Printed circuit boards of this type have the advantage that one can dispense with traditional wiring by means of individual cables. In fact, a printed or etched circuit board is provided, which includes the corresponding conducting paths, in order to connect the individual components together. Assembly is therefore made considerably easier. Simultaneously, a modular design can be considerably improved, since defined connection contacts or contact elements are provided along the printed circuit board for the components to be connected. The energy is then transferred via this printed circuit board instead of via connecting cables. In the process, a modified embodiment of this printed circuit board can be provided in such a way that on attachment of the printed circuit board to the lifting column, the lifting column is itself designed as a conductor, as is known in the body work of automobiles, for example.

A further preferred configuration of the printed circuit board provides current sensors, through which the state of charge of the respective energy storage device can be ascertained. Through this, the differential voltage between the input voltage of the conducting path on the energy storage device and the output voltage on the drive control can be ascertained. Due to the established resistance over the thickness and length of the conducting path, the current of the energy storage device can be determined and the state of charge can thus be ascertained. Furthermore, preferably, instead of an integration of the charging circuit on the energy storage device, the printed circuit board can also additionally include a charging circuit, so that via a connection contact on the printed circuit board, a charging process of the respective energy storage device(s) can be carried out via the charging circuit of the printed circuit board.

A further preferred configuration of the vehicle lifting platform intends that the energy storage device comprises a quick change device in the form of a connection plug, which can be stuck together with a complementary plug of the drive control and/or drive equipment. This arrangement also makes it possible for a quick replacement to take place. For example, a vehicle lifting platform can be completely fitted and provided with the components, and the drive control and/or the drive equipment can only be powered in situ by sticking both plug elements of the quick change device together. Here the plug which can be attached to the energy storage device can comprise two terminal poles for plus and minus, which can be easily attached to the poles of the energy storage device or can be positioned thereon.

Figure 2:
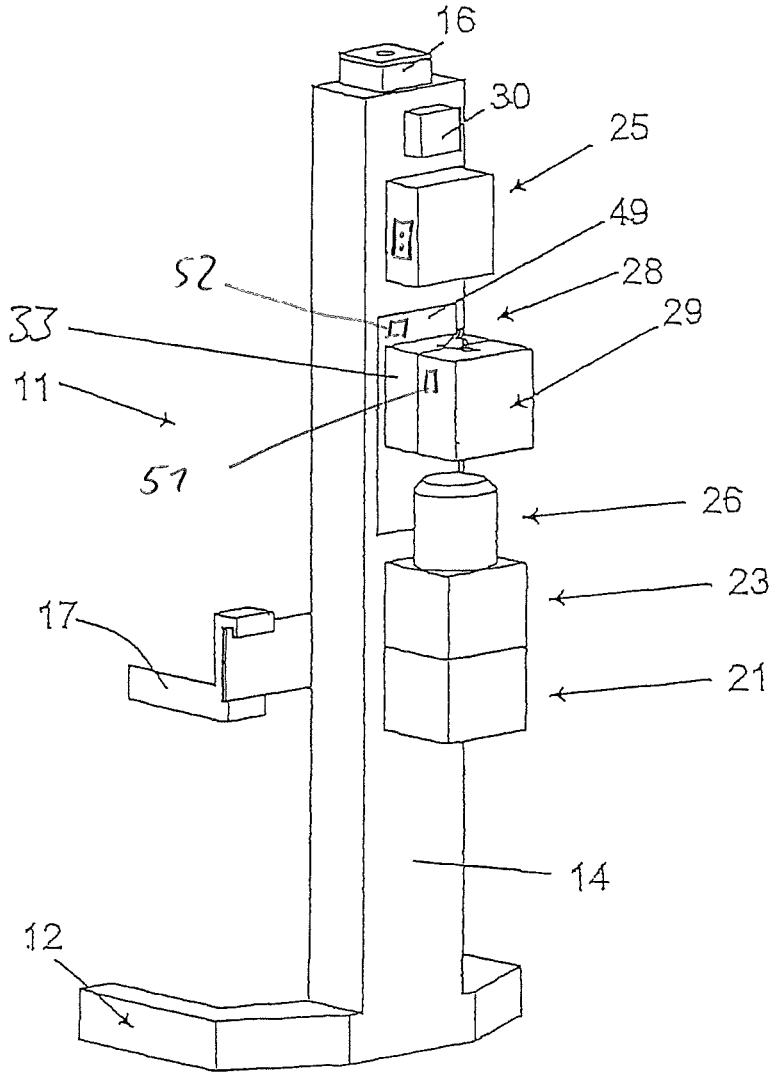
Figure 4:
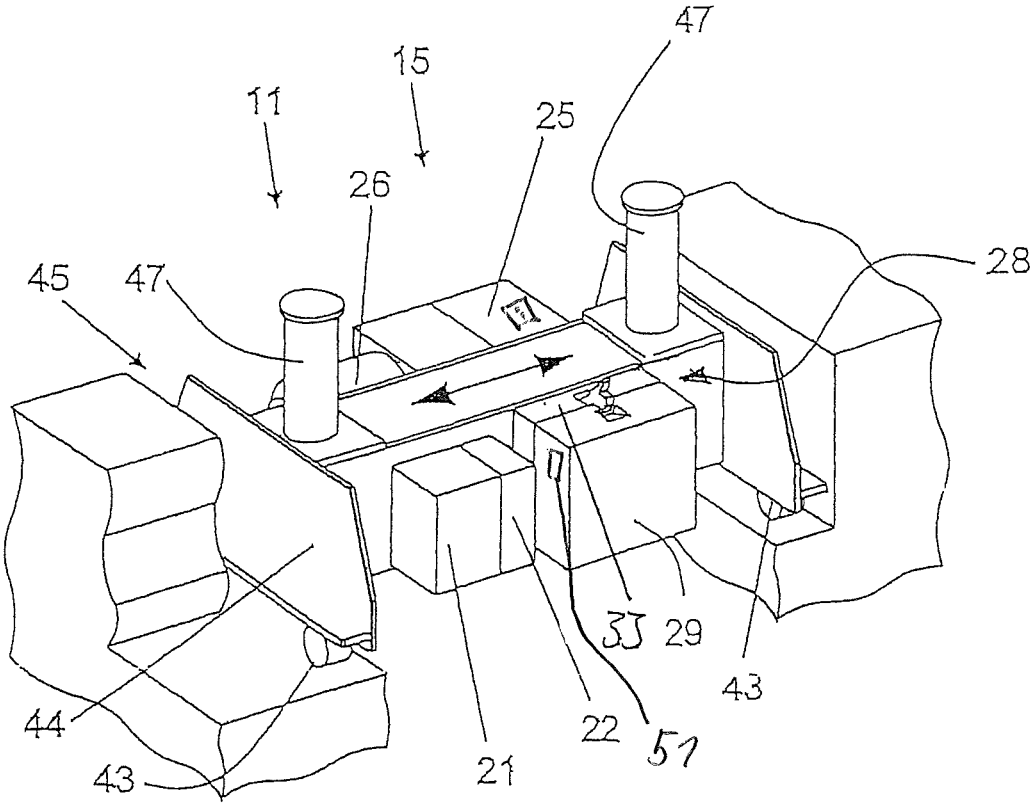

The invention as well as advantageous embodiments and further developments of the same are subsequently explained in more detail and described by means of the examples shown in the drawings. The features to be taken from the description and the drawings can be used individually or in any combination according to the invention. In the drawings:

FIG. 1 shows a schematic side view of a vehicle lifting platform according to the invention, FIG. 2 shows a perspective view of an alternative embodiment of a vehicle lifting platform according to FIG. 1, FIGS. 3*a* and *b* perspective representations of a quick change device with an energy storage device and FIG. 4 shows a schematic view of an alternative embodiment of a vehicle lifting platform according to FIG. 1.

A schematic side view of a vehicle lifting platform 11 according to the invention, which is suitable for mobile use, for example, is shown in FIG. 1.

Vehicle lifting platforms 11 of this type are also denoted as single column vehicle lifting platforms. The vehicle lifting platform 11 comprises a base device 12, which according to the execution example preferably includes a chassis or steering chassis. Alternatively, the base device 12 can also be formed as a supporting plate or mounting plate, by which the vehicle lifting platform 11 is attached to the floor of a workshop or of a mobile or stationary working space.

A lifting column 14 is provided on the base device 12. A drive unit 15, which moves a support 16 up and down relative to the lifting column 14, is attached to the lifting column 14. A load handling attachment 17, which supports a load to be lifted from underneath, is provided on the carrier 16. The load handling element 17 is preferably designed as a mobile column in a single column lifting platform. Other applications are also possible.

The drive equipment 15 includes a hydraulic unit 21, which drives a working cylinder, which is preferably arranged within the carrier 16. Alternatively, the drive equipment 15 can also be designed as an electrical or mechanical control, so that for example a spindle drive or similar can be controlled. For control of the hydraulic unit 21, a hydraulic control 23 is provided, which in turn is controlled by a drive control 25. This drive control 25 regulates the whole operation of the vehicle lifting platform 11.

An electric motor 26, which again drives the hydraulic unit 21, is provided between the drive control 25 and the hydraulic control 23. Above the drive control 25, a quick change device 28 is provided, which accommodates one or several energy storage devices 29 for energy supply of the vehicle lifting platform 11.

Via further wiring, for example, further sensors 30 are provided either for detection of an upper lifting end position and/or for unlocking a fall protection device.

The above-described arrangement and design of the superimposed components have the advantage that a compact arrangement and short connection cable are provided, in order to control the individual components from the drive control 25. It is preferably intended that the individual connection cables are designed with plug connections, so that a simpler modular design is given.

These vehicle lifting platforms 11 serve for lifting motor vehicles, commercial vehicles, speciality vehicles, railway vehicles or similar.

An embodiment of the vehicle lifting platform 11 which is alternative to FIG. 1 is shown in FIG. 2. In this embodiment, it is intended that the quick change device 28 is provided for accommodating the energy storage device(s) 29 between the electric motor 26 and the drive control 25. The quick change device 28 is attached to a printed circuit board 49, which is turn is mounted on the lifting column 14. The printed circuit board 49 comprises current sensors 52, through which the state of charge of the energy storage device 29 is ascertained. For the rest, the same designs apply as in FIG. 1.

A perspective front and rear view of the quick change device 28 with an energy storage device 29 to be arranged thereon is shown in FIGS. 3*a* and 3*b*. This quick change device 28 includes a mounting frame 33, which is designed as a plug base according to the execution example. A projection or protrusion 34, which corresponds to a complementary recess 35 on the energy storage device 29, is provided on the mounting frame 33. It is therefore ensured that the energy storage device 29 can only be used in a defined plug position in the mounting frame 33, and electrical contacting of the energy storage device 29 to the quick change device 28 takes place. Spring-loaded contact pins 38 are preferably arranged as electrical contacts on the energy storage device 29, which engage on the contact elements 37 in the mounting frame 33, when the energy storage device 29 and the quick change device 28 are in a locked state. The quick change device 28 is connected to the control electronics of the drive control 25 by the contact elements 37 and by the supply lines shown in FIG. 1. A locking element 41 such as a snap-in hook or a latching hook is provided for simple replacement of the energy storage device 29. By a simple positioning of the energy storage device 29 on the quick change device 28, contacting takes place, preferably as well as an independent locking of the locking device 41 on the energy storage device 29. By lifting or activating the locking element 41, disconnecting and removal of the energy storage device 29 is made possible, so that this can be charged again in a separate charging station.

The charging station can accommodate one or several energy storage devices 29 and is provided separately from the vehicle lifting platforms 11. It is therefore possible to charge the energy storage device 29 separately during operation of the vehicle lifting platforms 11. The energy storage device 29 can include an energy storage control 51.

There are therefore sufficient replacement energy storage devices available, so that there is always an energy storage device 29 if an exchange is required.

The quick change device 28 can be provided for accommodating several energy storage devices 29 which are arranged next to each other or above one another, whereby separate locking is preferably provided for each energy storage device 29. Alternatively, a locking frame can also be provided, which simultaneously fixes several energy storage devices 29 to the mounting frame 33.

The energy storage device 29 is designed as a high performance accumulator, particularly as a lithium ion battery. Other high performance accumulators can also be provided.

In FIG. 4, an alternative embodiment of a vehicle lifting platform 11 is shown perspectively as a so-called pit jack. Pit jacks of this type include a base frame 44 arranged on rollers 43 for forming a moveable carriage 45. By means of the rollers 43, the vehicle lifting platform 11 can be moved along the pit which extends in width between the right and left pair of rollers 43. Lifting cylinders 47 are provided as axle free jacks or other lifting devices on the base frame 44. For example, these lifting cylinders 47 are adjustable in width to the load to be taken, and can be moved along the base frame 44 according to the double arrow shown. These lifting cylinders 47 are preferably designed as hydraulic cylinders and comprise load handling attachments 17 on the upper end. Components analogous to those of the vehicle lifting platform 11 according to FIGS. 1 and 2 are provided for control of the pit jacks. The drive equipment 15 thus includes a hydraulic unit 21 with a hydraulic control 22 as well as a drive control 25, which is directly attached to an electric motor 26. The quick change device 28 is preferably arranged on the base frame 44 and accommodates an energy storage device 29, for example. An analogous design can be provided for the axle free jacks, which can be moved within a rail lifting platform. For the rest, the alternative embodiments and advantages of the above-named execution examples apply.

The invention claimed is:

1. A single column vehicle lifting platform for lifting vehicles, with a lifting column and a support led through the lifting column, wherein a load handling element is arranged on the lifting column or the support, with a drive equipment which is controlled by a wireless drive control, wherein the drive control moves the load handling element up and down, and with an energy storage device, wherein the energy storage device powers the wireless drive control and the drive equipment, wherein a quick change device is provided for interchangeable arrangement of the energy storage device and is arranged on the lifting column or the support and comprises at least one mounting frame, wherein the energy storage device is positively arranged in the at least one mounting frame and wherein the energy storage device includes an energy storage control, wherein the energy storage control is provided on or in a housing accommodating the energy storage device, and which monitors the state of charge of the energy storage device.

2. The vehicle lifting platform according to claim 1, wherein the mounting frame of the quick change device is provided as a plug-in socket for receiving the energy storage device.

3. The vehicle lifting platform according to claim 1, wherein the quick change device comprises a locking element, wherein the energy storage device is securely fastened to the mounting frame through the locking element.

4. The vehicle lifting platform according to claim 1, wherein the quick change device or the energy storage device comprises contacts.

5. The vehicle lifting platform according to claim 1, wherein the energy storage device is arranged above the wireless drive control, on the lifting column or on the carrier, and an electric motor of the drive equipment is provided directly underneath the wireless drive control, or that the wireless drive control is arranged above the energy storage device.

6. The vehicle lifting platform according to claim 1, wherein for moving the support up and down in relation to the lifting column, on the lifting column is provided a hydraulic unit and a hydraulic control, the hydraulic control is arranged above the hydraulic unit, an electric motor lying above the hydraulic control, and above the electric motor the wireless drive control is arranged, and above the wireless drive control the quick change device is provided for accommodating the energy storage device.

7. The vehicle lifting platform according to claim 1, wherein the energy storage device includes lithium ion batteries.

8. The vehicle lifting platform according to claim 1, wherein at least one plug connection for a charging or power supply cable is provided on the wireless drive control.

9. The vehicle lifting platform according to claim 1, wherein the energy storage device includes a charging circuit, wherein the charging circuit is provided on or in a housing accommodating the energy storage device.

10. The vehicle lifting platform according to claim 1, wherein the energy storage device comprises at least one data interface, wherein the at least one data interface communicates with the wireless drive control.

11. The vehicle lifting platform according to claim 1, wherein the mounting frame of the quick change device, is attached to a printed circuit board, which comprises conducting paths, wherein the conducting paths lead from contact elements of the quick change device to the wireless drive control or to an electric motor or to both of the drive equipment or to a hydraulic control or to both.

12. The vehicle lifting platform according to claim 11 wherein the printed circuit board comprises current sensors, wherein the state of charge of the energy storage device is ascertained through the current sensors.

13. The vehicle lifting platform according to claim 1, wherein the energy storage device includes the quick change device in the form of a connector plug, which is plugged together with a complementary plug of the wireless drive control or the drive equipment or both.

14. The vehicle lifting platform according to claim 2, wherein the quick change device comprises a locking element, wherein the energy storage device is securely fastened to the mounting frame through the locking element.

15. A single column vehicle lifting platform for lifting vehicles, with a lifting column and a support led through the lifting column, wherein a load handling element is arranged on the lifting column or the support, with a drive equipment which is controlled by a wireless drive control, wherein the wireless drive control moves the load handling element up and down, and with an energy storage device, wherein the energy storage device powers the wireless drive control and the drive equipment, wherein a quick change device is provided for interchangeable arrangement of the energy storage device and is arranged on the lifting column or the support and comprises at least one mounting frame, wherein the energy storage device is positively arranged in the at least one mounting frame, wherein the wireless drive control comprises a charging circuit for monitoring the state of charge of the energy storage device.

* * * * *